US005299409A

United States Patent [19]

Daane et al.

[11] Patent Number: 5,299,409

[45] Date of Patent: Apr. 5, 1994

[54] AUTOMATED LINE AND METHOD FOR PREPARING PREMADE FOOD SET-UPS

[75] Inventors: Larry E. Daane, Horicon; John A. Jonovic, Fitchburg; James A. Rattmann, Sun Prairie, all of Wis.

[73] Assignee: Oscar Mayer Foods Corporation, Madison, Wis.

[21] Appl. No.: 955,092

[22] Filed: Oct. 1, 1992

[51] Int. Cl.[5] ..... B65B 25/08

[52] U.S. Cl. ..... 53/435; 53/157; 53/240; 53/447; 53/517

[58] Field of Search ..... 53/517, 514, 515, 516, 53/518, 435, 157, 156, 532, 534, 249, 240, 237, 447

[56] References Cited

U.S. PATENT DOCUMENTS

| | | | |
|---|---|---|---|
| 2,126,458 | 8/1938 | Englen . | |
| 2,628,758 | 2/1953 | Gannon et al. | 53/517 X |
| 3,266,442 | 8/1966 | Udall et al. . | |
| 3,431,701 | 3/1969 | Vargas | 53/209 |
| 3,645,197 | 2/1972 | McMeekin et al. | 99/450.4 |
| 3,712,020 | 1/1973 | Norr et al. | 53/209 X |
| 3,788,030 | 1/1974 | Moline | 53/514 |
| 4,137,604 | 2/1979 | Sandberg et al. | 53/500 X |
| 4,428,263 | 1/1984 | Lindee et al. | 83/354 |
| 4,512,228 | 4/1985 | Tarcisio | 83/355 |
| 4,716,821 | 1/1988 | Mally et al. | 99/450.1 |
| 4,776,146 | 10/1988 | Whitehouse | 53/517 X |
| 4,821,616 | 4/1989 | Mayeux et al. | 83/355 |
| 4,832,537 | 5/1989 | Roberts et al. | 406/87 |
| 4,832,970 | 5/1989 | Mally et al. | 426/274 |

*Primary Examiner*—James F. Coan

*Attorney, Agent, or Firm*—Lockwood, Alex, FitzGibbon & Cummings

[57] ABSTRACT

An apparatus and method for the automated and large scale preparation of layered stacks of one or more food items such as sandwich meats, hors d'oeuvre servings and the like ("set-ups"). The apparatus conveys a continuous web of paper through a plurality of slicer stations, each slicer station providing one or more slices of one or more food items to sequentially form set-ups of two or more stacked layers of horizontally spaced food slices. The apparatus is synchronized so that each sliced layer is conveyed to a subsequent slicer station before the next layer of food slices is deposited directly on top of that previous layer. The set-up is formed with two or more stacked layers of food slices before being conveyed to a cutter/wrapping station where the paper web is cut to separate the finished set-ups which are then wrapped by folding a portion of the cut paper over the finished set-up. The wrapper separates the set-ups when they are subsequently stacked and packaged and also allows for the sanitary handling of the set-ups when they are unpackaged and used to make sandwiches or the like.

29 Claims, 4 Drawing Sheets

AUTOMATED LINE AND METHOD FOR PREPARING PREMADE FOOD SET-UPS

BACKGROUND AND BRIEF DESCRIPTION OF THE INVENTION

The present invention generally relates to automated devices and methods for the preparation of food items and, more specifically, to devices and methods for the automated preparation of layered stacks of one or more food items (hereinafter "set-ups") such as sandwich meats, hors d'oeuvre servings and the like. The invention provides a method and apparatus for the large-scale preparation of set-ups made with one or more food products. Each set-up is made of layered sliced stacks of food products. The method and apparatus of the invention can make the individual layers of the set-up with more than one type of sliced food item and with the slices arranged in a preferred pattern within a single horizontal plane. Set-ups made by the invention are automatically wrapped in paper and stacked with like set-ups for subsequent packaging and shipment. The invention is particularly useful in the commercial manufacture of sandwich set-ups made with one or more sliced meats or cheeses such as those used in making so-called "sub" sandwiches, for example.

The fast food industry has generally enjoyed continued growth in recent years and has seen a sustained demand by consumers for quick and efficient service and good product quality. Improvements in products and services as well as the introduction of new products has been necessary to capture market share and attain a comfortable profit margin in an increasingly competitive industry. Controlling costs, while providing a quality product and service, is a continuing concern within the industry. Food service providers have worked to control costs by controlling the size of the food portions in meal items served to customers. Carefully controlling the amount of meat and other materials used in sandwich set ups, for example, helps to control the overall cost in making and serving various sandwiches. While optimum control over portion sizes would best be achieved using automated machinery with readily reproducible equipment settings, the art has failed to provide such machinery for the manufacture of set-ups to duplicate the arrangement and selection of food items found in hand-made or manually assembled set-ups.

In controlling costs, industry generally strives to utilize its work force as efficiently as possible. In the food services industry, the preparation of set-ups has required a rather inefficient use of labor since the manual production of set-ups has typically been labor intensive, often requiring the dedicated attention and efforts of one or more individuals. Automation of a large scale set-up preparation process would allow the food service retailer to obtain premade set-ups, allowing for a more efficient use of labor by freeing individuals from time-intensive manual set-up preparation. In this manner workers would be able to dedicate more time to other important duties such as customer service, for example.

The present invention overcomes the shortcomings of the art by providing a mechanized system and method for the automated assembly of set-ups for distribution to individual vendors. The system is an automated assembly-line including a plurality of slicers for slicing meat, cheese and like products and depositing those sliced products onto a conveyor line. Timing mechanisms are provided so that the food items from successive slicers are deposited on the conveyor in close proximity to the slice or slices from preceding food slicers to form a plurality of premade sandwich set-ups, each set-up composed of a pattern of layered horizontally spaced food slices. The set-ups are stacked and then packaged for shipment to food service retailers for making sandwiches such as "submarine" type sandwiches, hors d'oeuvre servings and the like.

The system includes a paper roll supply and paper feed system from which a continuous sheet or web of paper is carried down a conveyor line through a plurality of slicer stations. Each slicer station deposits slices of one or more food items onto the conveyed web to thereby form a single layer of horizontally spaced slices. These slices are then conveyed to the next slicer station where another layer of food slices is deposited on top of the previous layer. As each set-up is conveyed down the conveyer line, each subsequent slicer station adds an additional layer of food to the set-up. The completed set-up is conveyed to a cutting station where the paper roll is automatically cut so that a portion of the paper can be used to cover and protect the set-up. The covered set-up is conveyed to a stacking station and the stacked set-ups are then conveyed to a packaging station where they are packaged for commercial shipment.

It is an object of the present invention to provide an apparatus and method for the automated manufacture of premade food set-ups.

It is another object of the present invention to provide an apparatus for the assembly of premade food set-ups wherein the apparatus includes a plurality of slicers which are arranged and timed to deposit sliced food product onto a conveyor at predetermined intervals to thereby assemble predetermined arrangements of food product to form a finished set-up.

It is still another object of the present invention to provide means for automatically stacking and packaging the premade set-ups once they have been assembled.

These and other objects of the present invention will become more apparent to those skilled in the art upon consideration of the remainder of the disclosure including the drawings, the detailed description of the preferred embodiment and the claims.

DETAILED DESCRIPTION OF THE PREFERRED EMBODIMENT

Figure 1:
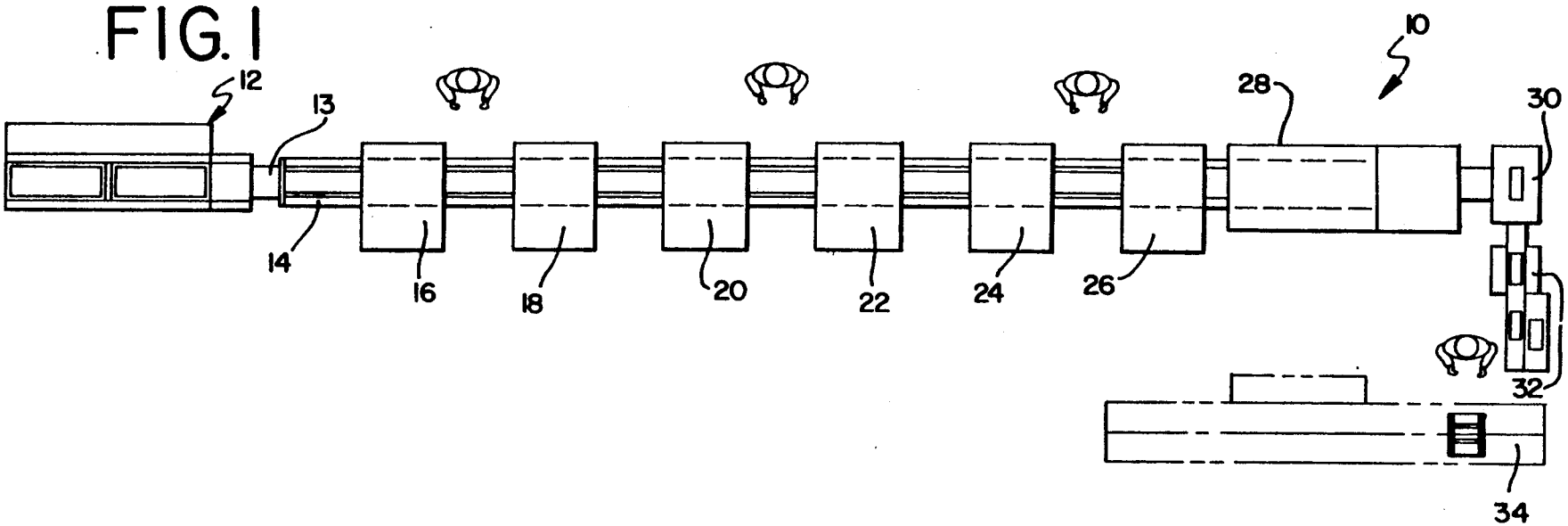
FIG. 1 is a top plan view of an apparatus for the assembly of premade food set-ups according to the present invention.

The present invention provides a mechanized system and a method for the large scale production of set-ups by utilizing a plurality of slicer stations positioned along a conveyor line to deposit a patterned array of layered food slices onto the conveyor, each successive slicer depositing a new patterned layer onto the layer deposited by the preceding slicer. In describing the preferred embodiment of the system and method, reference will be made to the various figures wherein like reference numerals indicate like components.

Referring now to the various figures, FIG. 1 illustrates the mechanized system 10 for the automated assembly of food set-ups in accordance with the present invention. The system 10, shown in schematic in FIG. 1, includes a paper supply 12 to supply a continuous sheet or web of paper 13 to a conveyor assembly including a conveyor 14 which extends down through a plurality of slicer stations 16–26. Each slicer station, as discussed below, deposits a layer of one or more food slices onto the paper 13 as it progresses downstream on conveyor 14. In this manner, a set-up is assembled in the form of several layers of food slices wherein each layer is composed of horizontally spaced slices arranged in a predetermined pattern. It will be appreciated that the number of slicer stations in the system 10 can be varied to include any number of two or more stations. The six stations 16–26 in the preferred embodiment has been most useful in the preparation of set-ups for "sub" sandwiches and the like.

The conveyor 14 transports each set-up to a cutter/-wrapper station 28. The cutter/wrapper station is equipped with a paper cutter to slice the continuous sheet 13 to predetermined lengths with each such length being sufficient to hold one set-up thereon and including a flap of excess paper. Preferably, the flap is long enough to be folded back over the set-up so that the set-ups can subsequently be stacked with the folded paper separating the individual set-ups and providing a means for the sanitary handling of individual set-ups such as when a set-up is eventually included in a sandwich, for example. The system 10 includes a wrapper assembly to fold excess paper 13 over each of the set-ups to thereby wrap the set-up prior to stacking. A stacker station 30 stacks the wrapped set-ups and conveys them on to a checkweigher 32 and from the checkweigher to a packaging station 34 where the set-ups are packaged for commercial shipment.

As mentioned, the system 10 is provided with a plurality of slicer stations to provide the desired number of different layers of food slices in the assembled set-ups. Each of the slicer stations are preferably equipped to deposit more than one food slice onto the paper 13 as it is conveyed by conveyor 14. Consequently, each slicer may be equipped to provide slices of one or more different types of meat, cheese and the like.

Figure 2:
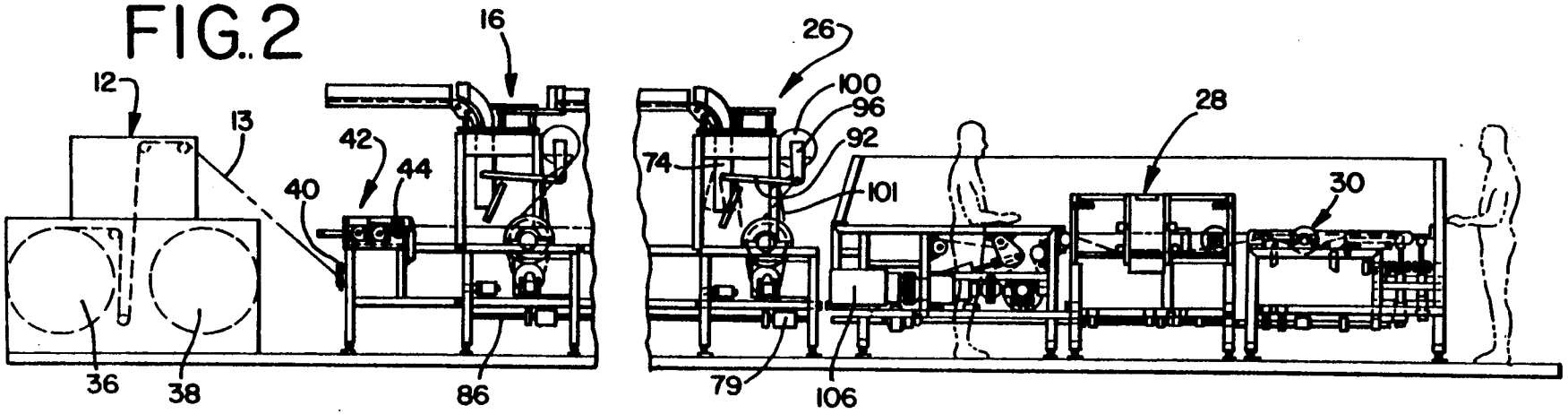
FIG. 2 is a side elevational view of an apparatus for the assembly of premade food set-ups, according to the present invention.

As shown in FIG. 2, the paper supply 12 is a paper roll stand accommodating a feed roll 36 and a spare roll 38 to facilitate changing paper supplies when the feed roll 36 is spent. In the preferred embodiment, the paper supply 12 is a combined splicer and paper roll stand unit, capable of automatically splicing in a new roll of paper at the end of the roll in service. Commercially available units, like those available from Serco USA, are adequate. The paper 13 is fed from the feed roller 36 onto the conveyor 14 through a paper guide roller 40 and a paper feeder 42, including nip rollers 44 for guiding the paper 13 onto the conveyor line 14. The paper 13 proceeds from the paper feeder 42 through nip rollers 44 down the conveyor line 14 and through the slicer stations 16–26.

Beginning with the first slicer station 16, each food set-up is assembled by compiling multiple layers of food slices to include a variety of foods such as various meats, cheeses or combinations thereof and the like. Each of the slicer stations is preferably capable of depositing more than one slice onto the paper 13. In this manner, each slicer station in the system 10 can deposit a separate layer of horizontally spaced food slices on the paper web 13, thereby building layers of food slices as the set-up advances downstream on the conveyor 14 through the individual slicer station 16–26.

Figure 3:
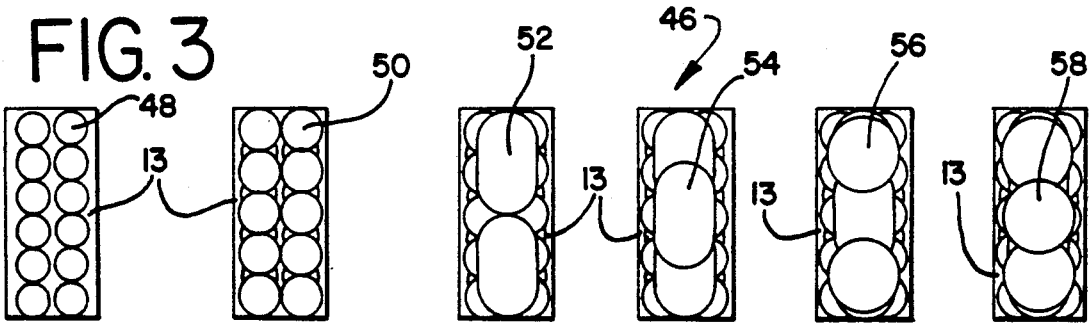
FIG. 3 is a top plan view, in schematic, illustrating the assembly of a set-up.

With particular reference to FIG. 3, a single set-up 46 is shown in various degrees of assembly. The first layer 48 of food slices are deposited on the paper 13 by first slicer station 16. As shown, the multiple food slices of the first layer 48 are deposited by the slicer station 16 onto the paper 13 in a horizontally spaced relationship. As the web 13 is carried downstream, the first layer 48 is similarly advanced and is conveyed through the second slicer station 18 where the second layer of food 50 is deposited onto the paper 13 and over the first layer 48. Most preferably, the slicer stations and the conveyor 14 are appropriately synchronized so that the second layer 50 lays directly on top of the first layer. Like the first layer 48, the second layer 50 includes horizontally spaced food slices which lie approximately within a single horizontal plane. As the set-up is conveyed further through the system 10, a third layer of food 52 is deposited thereon by slicer station 20 and is again deposited in a horizontally spaced relationship. In the embodiment herein, the third layer 52 consists of two slices of food. The next slicer station 22 similarly deposits the fourth layer 54 of food slices onto the set-up and subsequent slicer stations 24, 26 similarly deposit additional layers of food slices 56 and 58, respectively.

Figure 4:
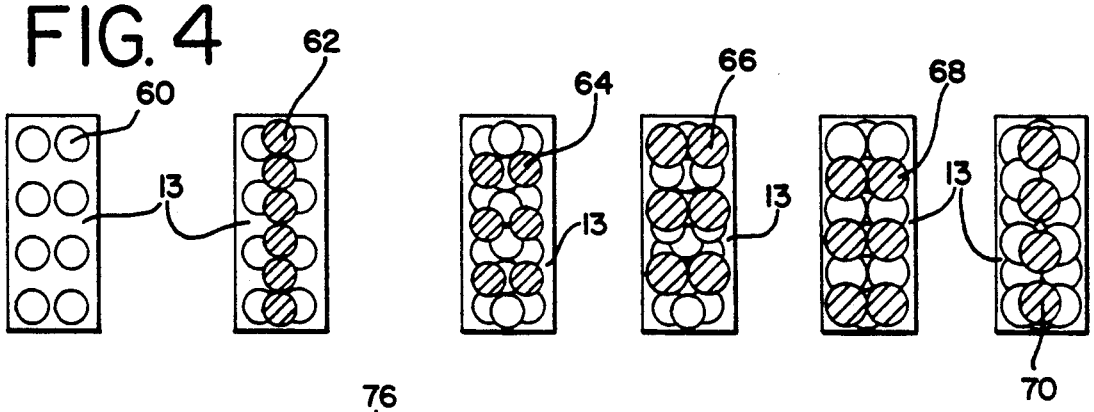
FIG. 4 is another top plan view, in schematic, showing the assembly of a set-up in six stages.

For illustrative purposes, FIG. 4 shows a somewhat different arrangement of food slices in a second set-up composed of a variety of food. Again, the first layer 60 is deposited by slicer station 16 and the subsequent layers of food slices 62, 64, 66, 68, and 70 are similarly deposited by slicer stations 18, 20, 22, 24 and 26, respectively. It will be understood that FIGS. 3 and 4 provide only two examples of many possible set-up arrangements. Those skilled in the art will understand that various different arrangements of food placement onto the paper 13 are possible, limited only by the selection of food items and the capacity of the slicers stations 16–26. The slicers are preferably capable of depositing more than one food item onto the paper 13 and the number of items which can be deposited by each of the individual slicers is limited by the capacity of the slicer as well as the size of the food casings, as discussed below.

Figure 5:
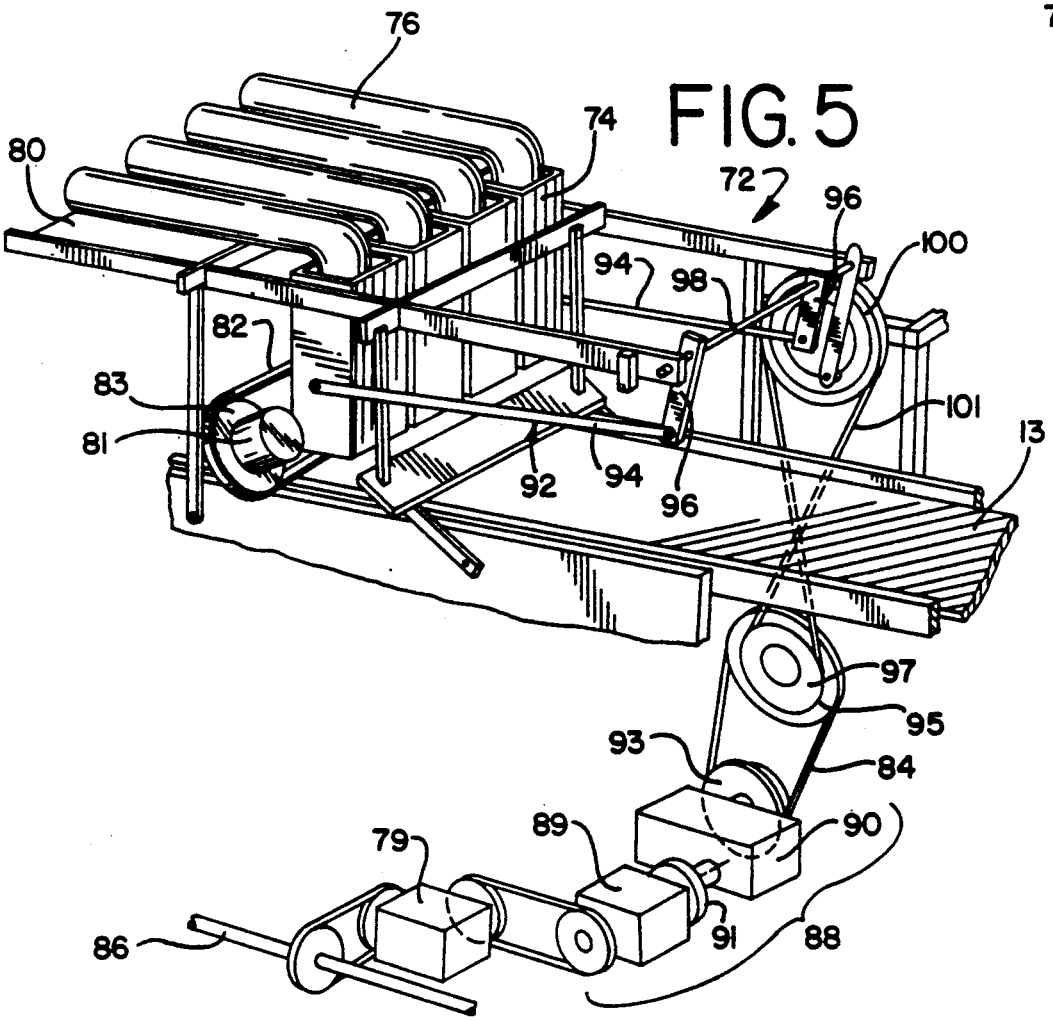
FIG. 5 is a perspective view of a slicer used in the apparatus of the present invention.

Regarding the individual slicer stations, each station is preferably equipped with an assembly 72, as shown in FIG. 5. The assembly 72 is mounted over the conveyor assembly 14 and the paper 13 conveyed thereon. The assembly 72 is of known construction, and commercial slicers such as those available from J. E. Grote Pepp-A-Matic Co., Inc. of Columbus, Ohio are suitable. As shown one or more moveable canisters 74 each receive an elongated cylinder or log of food product 76 such as cheese, meat and the like. Each of the log 76 is vertically oriented and held within a canister 74. The canisters 74 are supported by a frame assembly 78 which is also equipped with a tray 80 to support the uppermost portions of the food products 76 as well as providing an area for the temporary storage of refill food products.

The frame assembly 78 supports the canisters 74 to allow the bottoms thereof to simultaneously move above a slicer blade 82 positioned beneath the canister in a closely spaced relation thereto. Each log 76 projects slightly beneath the bottom of its canister 74 to allow the blade 82 to slice the food product and to have the food slices fall onto the paper web 13 in a predetermined pattern. As shown, the blade 82 provides a constant cutting motion to the food products by rotation around a pair of blade pulleys 83 and driven by motor 81 at a constant and predetermined rate of speed. In this manner, the blade 82 operates like a band saw, providing a cutting surface to quickly and easily slice through a plurality of food logs 76 within the canisters 74.

The canisters 74 are driven by an oscillating cable drive which is powered by the line shaft 86 or the like by the operation of a drive assembly. The line shaft 86 rotates at a constant velocity, preferably about 900 rpm, to drive the conveyor assembly 14 in a known manner at a velocity of about 27 inches per second. The line shaft 86 also drives the drive assembly preferably through a conventional cable and pulley connection to a gear box 79 to reduce the rotational drive of line shaft 86 from about 900 rpm to about 600 rpm. The drive assembly 88 directs the rotational input from the line shaft 86 and the aforementioned gear box through phaser 89 and an air clutch 91 to an oscillator 90 which operates in a known manner to convert the constant rotational input to an oscillating output. The rotational input into oscillator 90 from the air clutch 91 is preferably about 150 rpm which is translated into an oscillating motion of about 21.52 degrees, through oscillator 90, to a cable pulley 93 which is associated with an overload clutch (not shown). Cable 84 is reeved around an oscillating drive pulley 93 and the large diameter driven pulley 95. The drive pulley 93 is driven by oscillator 90 at an appropriate rate of oscillation. A smaller diameter cable pulley 97 is associated with the driven pulley 95 to drive the cable pulley 100 with associated cable 101.

Through the aforementioned arrangement of parts, the cable drive 84 drives a linkage assembly 92 and, the linkage assembly 92 moves the canisters 74 across the slicer blade 82 with a velocity of about 150 oscillations per minute to cut and place a food slice precisely onto the partially assembled set-up from the preceding slicer station, supplying about 150 set-ups per minute.

The linkage assembly 92, shown in FIG. 5, includes tierods 94, each of which is secured at one end to the carrier 74 and at its other end to a lever arm 96. Each lever arm 96 is secured to a rotatably mounted shaft 98. The cable pulley 100 is mounted o the rotatably mounted shaft 98 at one end thereof and, transmits the oscillating motion from the oscillator 90 to the shaft 98.

To assure synchronized operation of the various slicer stations, each station is preferably driven from a single drive assembly which can include a motor 106 to drive a common drive unit such as the line shaft 86. Phasers and reducers are preferably included within the drive chain as discussed to achieve desired timing and sequencing of the particular slicer stations.

Figure 8:
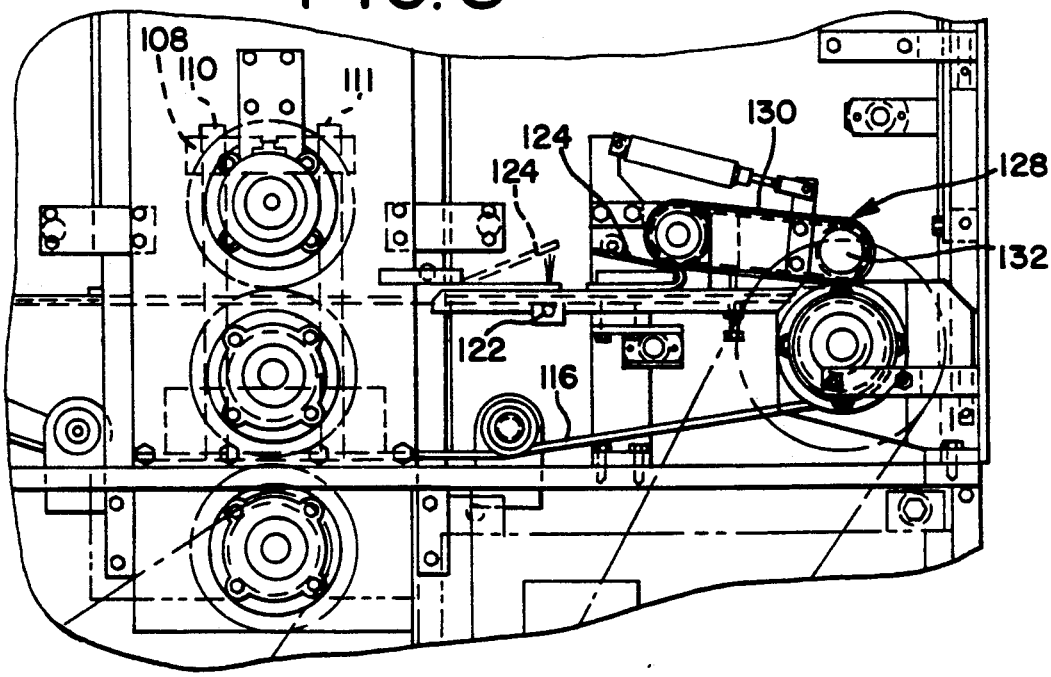
FIG. 8 is a side elevational view, in section, of the cutter/wrapper station of FIGS. 6 and 7 and illustrating the wrapper folding components thereof.

Once assembled by the slicer stations, each set-up is conveyed to the cutter/wrapper station 28 which, with some modification, is of a design known to those in the art. The cutter/wrapper station 28 cuts the web 13 in front of the set-up, leaving a flap 124 (FIG. 8) of paper to extend forwardly beyond the set-up. As described below, the station 28 includes a wrapper portion which wraps the forward flap back over the set-up for the stacking and subsequent handling thereof.

The cutter/wrapper station 28 includes a knife assembly 108 having a cutting blade 110 and a perforating blade 111 mounted on a top plate 112. The portion of the conveyor extending through the cutter/wrapper station and beneath the knife assembly 108 is separate from the portion of the conveyor 14 extending through slicer stations 16–26. Through the cutter/wrapper station 28, set-ups are conveyed on a conveyor portion having a plurality of urethane belts 116 which are reeved around a drive roller 120 and a series of idler rollers in a known manner and driven by the drive assembly 106 and the line shaft 86 so that the speed of the belts 116 is substantially the same as the speed for the conveyor 14 extending through the slicer station 16–26. The belts 116 extend under the knife assembly 108 through slots 113 in a bottom plate 114. The slots 113 provide each of the belts 116 with a recessed track to protect the belts from the guillotine action of the knife assembly 108 and the consequent undesired slicing of the belts 116.

The knife assembly 108 cuts and scores the paper web 13 and is synchronously driven by the line shaft 86 to operate in concert with the belts 116 as well as the slicer station 16–26. In this manner, the cutting blade 110 first cuts the web 13 in front of each set-up before the set-up has passed under the cutting blade, leaving a leading flap 124 in front of the set-up. Preferably, the length of the flap 124 will roughly correspond with the length of the set-up, as measured along the longitudinal axis of the conveyor 14. Preferably, this length will be between about 4 and about 8 inches and, most preferably, between about 5 and about 6 inches and roughly corresponding to the length between the cutting blade 110 and the perforating blade 111.

Following the initial cut of the web 13, the knife assembly 108 is raised and the web and set-up continue to advance along the conveyor belts 116, next passing underneath the knife assembly 108. Once the set-up has passed the vertical plane of the cutting blade 110 so that the set-up is approximately centered between the cutting blade and the perforating blade 111, the knife assembly 108 will again descend so that the cutting blade 110 cuts the web 13 a second time directly behind the set-up thereby separating that set-up from the other set-ups still being conveyed through the slicer stations 16–26. The perforating blade 111 simultaneously scores the paper in front of the leading edge of the set-up to provide a folding line for the flap 124.

Figure 6:
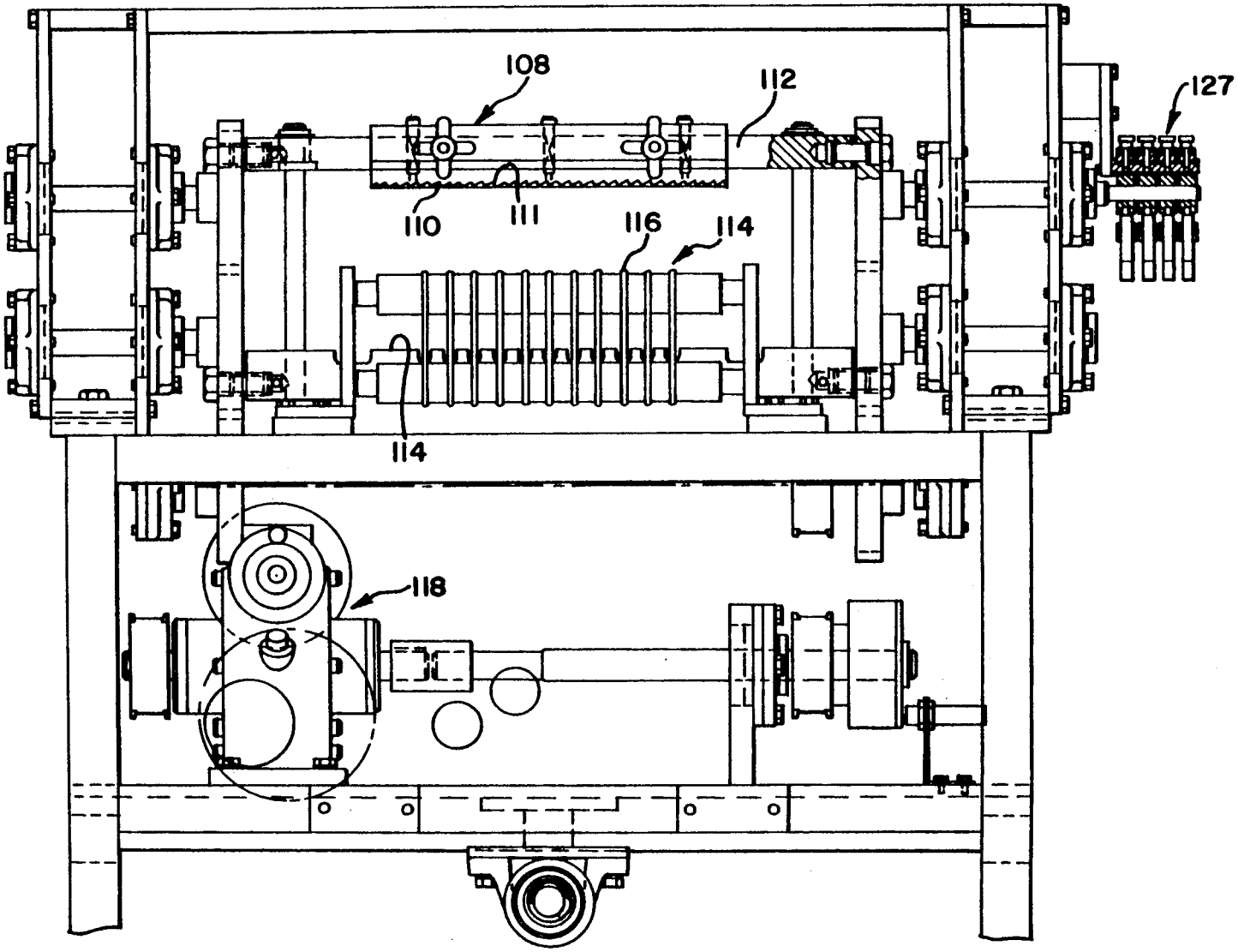
FIG. 6 is a front elevational view of a paper cutter/-wrapper station for use in the present invention.
Figure 7:
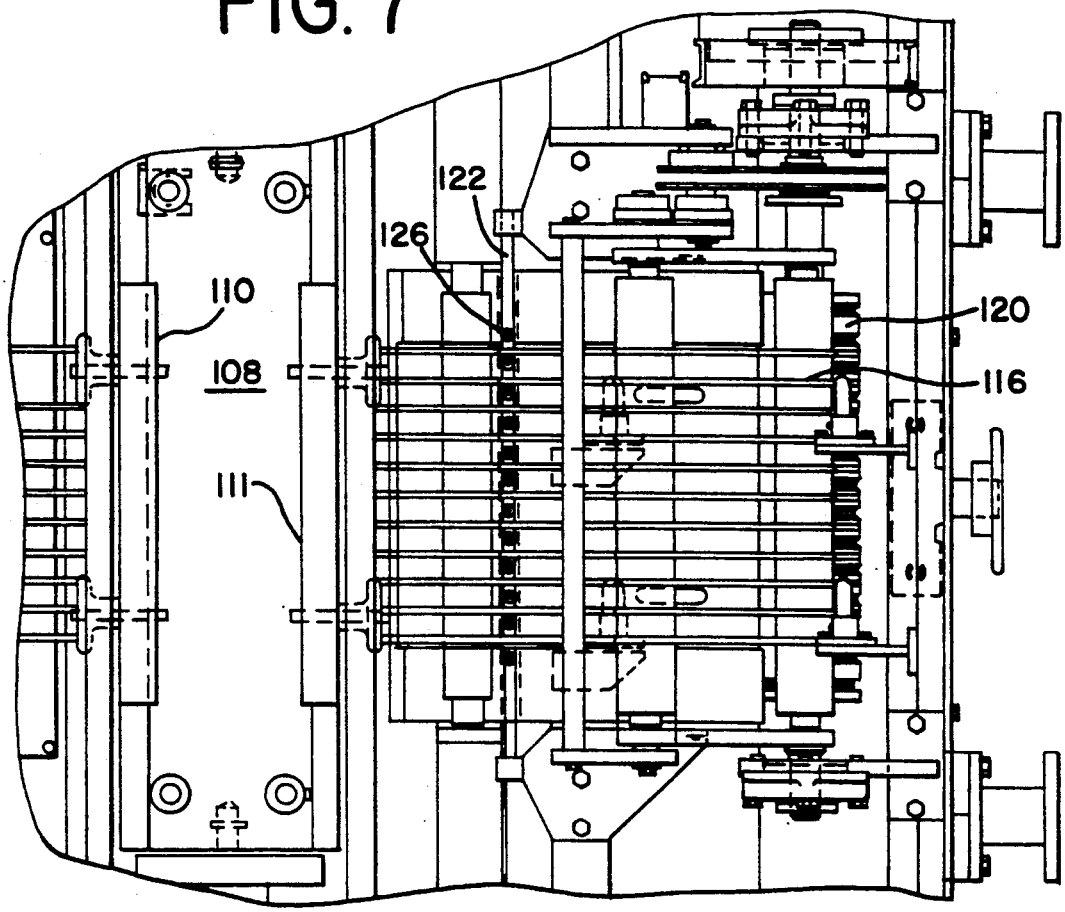
FIG. 7 is a top plan view, in section, of the cutter/-wrapper station of FIG. 6.

While the knife assembly 108 is still in its lowered position, the flap 124 is positioned over an air supply 122 extending beneath the belts 116 and supplying an upwardly directed stream of air from a series of individual openings 126 between the belts 116. The stream of air from the openings 126 of air supply 122 lifts the flap 124 while the perforating knife 111 is still applying pressure on the web 13. A series of proximity switches 127 (FIG. 6) are provided to control the air supply 122, cycling the air supply on while the flap 124 is positioned over the openings 126 and cycling off again before the set-up passes over the openings 126. In this manner, the upwardly directed stream of air will raise the flap 124 but provides no lifting force underneath the individual set-ups, thereby avoiding any alteration of the orientation of the set-ups as they are conveyed along the urethane belts 116. Use of the proximity switches 127 to cycle the air supply is accomplished in a known manner. In this arrangement, the air supply will lift the flap 124 from its horizontal orientation on the belts 116 to a vertically inclined position above the plane of the conveyor belts. The flap 124 is vertically inclined from the score line created by the perforating knife 111 to its leading edge, substantially as shown in phantom in FIG. 8.

With the flap 124 raised and the air supply cycled off, the set-up and flap 124 are advanced along the belts 116 to the folding roller 128 including a belt 130 conveyed around rollers 132. The folding roller 128 is positioned over the urethane belts 116 leaving sufficient space therebetween to allow the set-up to pass under the roller 128 and onto the stacker assembly 30. The speed of the folding roller 128 is synchronized with that of the belts 116. In the view shown in FIG. 8, the belt 130 is driven around the rollers 132 in a counterclockwise rotation. In this manner, the vertically inclined flap 124 encounters the belt 130 and, as the set-up advances along the belts 116, the flap 124 is folded over the set-up by the belt 130 to cover the set-up and thereby provide separation between the individual set-ups when stacked at stacker station 30 and, perhaps more importantly, to also provide a means for the sanitary handling of the individual set-ups when they are subsequently included in sandwiches by a food service retailer, for example.

The folded set-ups are conveyed to the stacker station 30 and on to the checkweigher 32 and the packaging station 34 for packaging of the set-ups for commercial shipment thereof. The checkweigher 32 and packaging assembly 34 are commercially available and well known to those skilled in the art. Both the cutter/wrapper station 28 and the stacker assembly 30 are driven by the line shaft 86, cycling on at any time the line shaft is turning. Preferably, the stacker assembly 30 is equipped with a reject system of a known design. A diverter system is preferably provided opposite the reject unit and is used to shift between two stackers. The stacker assembly used in the system of the present invention includes a photosensor control (not shown) wherein a photosensor eye is used to actuate the reject system along with a reject button. A second set of photosensors is located at the diverter to count set-ups and a third set of photosensors is located in front of the stacker shelves and used to move the shelf down at the correct time.

While a preferred embodiment of the invention has been described along with a preferred method for the automated formation of set-ups, those skilled in the art will understand that the described embodiment can be modified by those skilled in the art without departing from the true spirit and scope of the invention, as defined in the following claims.

What is claimed is:

1. A mechanized system for the automated preparation of food set-ups, comprising:

a paper supply means for supplying a continuous sheet of paper;

a conveyor assembly for conveying said sheet of paper thereon, said conveyor assembly having a feed end and a discharge end thereon, said conveyor assembly having a feed end and a discharge end thereon, said feed and including feeder means to feed said paper from said paper supply and onto said conveyor assembly;

first and second slicer means sequentially positioned along said conveyor assembly for sequentially providing food slices, said first slicer means configured to deposit a first layer of sliced food onto said sheet of paper substantially within a first horizontal plane, said second slicer means positioned downstream of said first slicer means and configured to deposit a second layer of sliced food substantially within a second horizontal plane, said first and second slicer means each capable of holding a food item above said sheet of paper, and each said slicer means also including a slicer blade in an operative position to slice said food onto said sheet of paper;

drive means for supplying operating power to said conveyor assembly and said slicer means; and timing means for synchronizing said first and second slicer means so that said second layer of sliced food slices is deposited over said first layer of sliced food;

whereby said layers of food slices form a set-up including a plurality of stacked layers wherein each layer includes food slices arranged substantially within a single horizontal plane.

2. The system as defined in claim 1 wherein said conveyor assembly includes a continuous conveyor running from said first slicer means to and away from said second slicer means.

3. The system as defined in claim 1, further comprising:

cutting means disposed downstream of said second slicer means and along said conveyor assembly for cutting said paper to thereby separate each said set-up, said cutting means operatively associated with said timing means to cut said paper to a predetermined length for each set-up, said cutting means including a knife positioned over said conveyor assembly to slice said paper as each said set-up is conveyed thereunder, said knife cutting said paper to leave a flap of paper of sufficient length to fold over said set-up;

wrapper means associated with said cutting means to fold said flap over said set-up;

stacking means positioned downstream of said wrapper means to stack said set-ups after said flap has been folded over said set-up; and packaging means associated with said stacking means to package said set-ups after stacking thereof.

4. The system as defined in claim 3 wherein said wrapper means further includes an air source to supply an upwardly directed stream of air to lift said flap and folding means to fold said flap over said set-up, said folding means including a folding roller positioned over said conveyor to fold said flap over said set-up as said set-up is conveyed along said conveyor assembly.

5. The system as defined in claim 1, further comprising:

third, fourth, fifth and sixth slicer means sequentially positioned along said conveyor assembly downstream of said second slicer means for sequentially providing additional layers of sliced food, said third, fourth, fifth and sixth slicer means configured to supply a third, fourth, fifth and sixth layer, respectively, so that each said layer lays substantially within a single horizontal plane on said set-up.

6. The system as defined in claim 1, wherein said first and second slicer means further include a moveable canister mounted on a frame and positioned above said sheet of paper, said canister equipped to hold multiple food items therein, said slicer blade positioned beneath said canister and extending across said paper perpendicular to the path of travel thereof, said blade being of sufficient length to simultaneously slice more than one food item within said canister.

7. The system as defined in claim 1 wherein said drive means is a line shaft drive for simultaneously driving said conveyor assembly and said slicer means.

8. A mechanized system for the automated preparation of food set-ups, comprising:

a conveyor assembly having a feed end and a discharge end thereon;

first, second, third, fourth, fifth and sixth slicer means sequentially positioned along said conveyor assembly for sequentially providing food slices, said first slicer means capable of depositing a first layer of food slices onto said conveyor assembly substantially within a first horizontal plane, said second slicer means positioned along said conveyor assembly and downstream of said first slicer means, said second slicer means capable of providing a second set of food slices substantially within a second horizontal plane and said third, fourth, fifth and sixth slicer means positioned downstream of said second slicer means and configured to supply a third, fourth, fifth and sixth layer, respectively, so that each said layer is substantially within a single horizontal plane in said set-up;

drive means for driving said conveyor assembly and said slicer means; and timing means for synchronizing said slicer means and said conveyor assembly so that each said set of food slices is provided by said slicer means to lay over a previously deposited set of food slices;

whereby, said slicer means compile a food set-up having a plurality of stacked layers wherein each layer includes food slices arranged substantially within a single horizontal plane.

9. The system as defined in claim 8 wherein said conveyor assembly includes a continuous conveyor running from said first slicer means to and away from said second slicer means.

10. The system as defined in claim 8 wherein said drive means is a line shaft drive for simultaneously driving said conveyor assembly and said slicer means.

11. The system as defined in claim 8, wherein said slicer means further include a moveable canister mounted on a frame and positioned above said conveyor assembly, said canister equipped to hold multiple food items therein; a slicer blade positioned beneath said canister and above said conveyor assembly, said slicer blade extending across said conveyor assembly perpendicular to the path of travel thereof, said blade being of sufficient length to simultaneously slice more than one food item within said canister.

12. A method for the automated preparation of food set-ups, comprising:

providing a continuous web of paper;

conveying said continuous web of paper on a conveyor line to said first slicer station;

slicing a first set of food items at a first slicer station to provide a first layer of food slices;

depositing said fist layer onto said web of paper and substantially within a first horizontal plane;

conveying said first layer and said paper to a second slicer station;

slicing a second set of food items at said second station to form a second layer of food slices;

stacking said second layer directly over said first layer and substantially within a second horizontal plane;

cutting said web of paper to leave a flap of said paper of sufficient length to be folded over said layers to provide a wrapper therefor;

wrapping said first and second layers following said stacking thereof; and packaging said first and second layers following said wrapping thereof.

13. The method as defined in claim 12, wherein said wrapping includes supplying an upwardly directed stream of air to raise said flap from a substantially horizontal position to a vertically inclined position; and applying a roller over said flap and said first and second layers when said flap is in said vertically inclined position to thereby fold said flap over said layers.

14. A mechanized system for the automated preparation of food set-ups, comprising:

a paper supply means for supplying a continuous web of paper;

a conveyor assembly including a continuous conveyor for conveying said web thereon, said conveyor having a feed end and a discharge end thereon, said feed end including feeder means to feed said web from said paper supply means and onto said conveyor;

a plurality of slicer means sequentially positioned along said conveyor for sequentially providing food slices, each of said slicer means capable of depositing a single layer of food slices onto said web of paper and substantially within a single horizontal plane;

cutting means disposed downstream of said slicer means and along said conveyor for cutting said web of paper to predetermined lengths, said cutting means including a knife positioned over said conveyor to slice said web to said predetermined lengths;

wrapper means associated with said cutting means to wrap each set-up said wrapper means including an air source to supply an upwardly directed stream of air to lift a flap of said paper after said paper has been cut by said cutting means, said wrapper means also including a roller positioned over said conveyor to fold said flap back over the set-up.

15. The system as defined in claim 14 wherein each of said slicer means include a moveable canister mounted on a frame and positioned above said web of paper, said canister dimensioned to hold multiple food items therein; and a slicer blade positioned beneath said canister and extending across said web of paper perpendicular to the path of travel thereof, said blade being of sufficient length to simultaneously slice more than one food item within said canister.

16. The system as defined in claim 14 wherein said wrapper means further includes an air source to supply an upwardly directed stream of air to lift a flap of said paper after said paper has been cut by said cutting means, said wrapper means including a roller positioned over said conveyor to fold said flap back over the set-up.

17. A method for the automated preparation of food set-ups, comprising:

loading a first set of food items into a first slicer station and above a first slicer blade so that said first set is moveable relative to said first slicer blade;

positioning said food items in a side-by-side arrangement to expose one end of each said food item for slicing thereof by said slicer blade;

slicing said one end of each said food item within said first slicer to form a first layer of food items;

depositing said first layer onto a conveyor and substantially within a first horizontal plane;

conveying said first layer to a second slicer station;

slicing a second set of food items at said second station to form a second layer of food slices;

stacking said second layer directly over said first layer and substantially within a second horizontal plane;

wrapping said first and second layers following said stacking thereof; and packaging said first and second layers following said wrapping thereof.

18. The method as defined in claim 17 wherein said conveying of said first layer to said second slicer station is accomplished on a line shaft conveyor.

19. The method as defined in claim 17 wherein said slicing of said second set of food items includes loading one or more food items into a second moveable canister, said second canister positioned over a second slicer blade and moveable relative to said slicer blade;

positioning said food items within said second canister in a side-by-side arrangement to expose one end of each said food item for slicing thereof by said second slicer blade;

slicing said one end of each said food item within said second canister to form said second layer.

20. The method as defined in claim 17 further comprising:

providing a continuous web of paper;

conveying said continuous web of paper on a conveyor line to said first slicer station;

depositing said first layer onto said paper;

conveying said first layer and said paper on said conveyor line to said second slicer station and depositing said second layer onto said first layer;

cutting said web of paper to leave a flap of said paper of sufficient length to be folded over said layers to provide a wrapper therefor; and wrapping said layers with said paper following said cutting thereof.

21. The method as defined in claim 20, wherein said wrapping includes supplying an upwardly directed stream of air to raise said flap from a substantially horizontal position to a vertically inclined position; and applying a roller over said flap and said first and second layers when said flap is in said vertically inclined position to thereby fold said flap over said layers.

22. A mechanized system for the automated preparation of food set-ups, comprising:

a paper supply means for supplying a continuous sheet of paper;

a conveyor assembly for conveying said sheet of paper thereon, said conveyor assembly having a feed end and a discharge end thereon, said feed end including feeder means to feed said paper from said paper supply and onto said conveyor assembly;

first and second slicer means sequentially positioned along said conveyor assembly for sequentially providing food slices, said first slicer means configured to deposit a first layer of horizontally spaced food slices onto said sheet of paper substantially within a first horizontal plane, said second slicer means positioned downstream of said first slicer means and configured to deposit a second set of horizontally spaced food slices substantially within a second horizontal plane;

drive means for supplying operating power to said conveyor assembly and said slicer means;

timing means for synchronizing said first and second slicer means so that said second set of food slices is deposited to lay over on said first set of food slices;

said layers of food slices form a set-up including a plurality of stacked layers wherein each layer includes food slices arranged substantially within a single horizontal plane;

cutting means disposed downstream of said second slicer means and along said conveyor assembly for cutting said paper to thereby separate each said set-up, said cutting means operatively associated with said timing means to cut said paper to a predetermined length for each set-up, said cutting means including a knife positioned over said conveyor assembly to slice said paper as each said set-up is conveyed thereunder, said knife cutting said paper to leave a flap of paper of sufficient length to fold over said set-up;

wrapper means associated with said cutting means to fold said flap over said set-up;

stacking means positioned downstream of said wrapper means to stack said set-ups after said flap has been folded over said set-up; and packaging means associated with said stacking means to package said set-ups after stacking thereof.

23. The system as defined in claim 22 wherein said wrapper means further includes an air source to supply an upwardly directed stream of air to lift said flap and folding means to fold said flap over said set-up, said folding means including a folding roller positioned over said conveyor to fold said flap over said set-up as said set-up is conveyed along said conveyor assembly.

24. A mechanized system for the automated preparation of food set-ups, comprising:

a paper supply means for supplying a continuous sheet of paper;

a conveyor assembly for conveying said sheet of paper thereon, said conveyor assembly having a feed end and a discharge end thereon, said feed end including feeder means to feed said paper from said paper supply and onto said conveyor assembly;

first, second, third, fourth, fifth and sixth slicer means sequentially positioned along said conveyor assembly for sequentially providing food slices, said first slicer means configured to deposit a first layer of horizontally spaced food slices onto said sheet of paper substantially within a first horizontal plane, said second slicer means positioned downstream of said first slicer means and configured to deposit a second set of horizontally spaced food slices substantially within a second horizontal plane and said third, fourth, fifth and sixth slicer means sequentially positioned along said conveyor assembly downstream of said second slicer means for sequentially providing additional layers of food slices, said third, fourth, fifth and sixth slicer means configured to supply a third, fourth, fifth and sixth layer, respectively, so that each said layer lays substantially within a single horizontal plane on said set-up;

drive means for supplying operating power to said conveyor assembly and said slicer means; and timing means for synchronizing said slicer means so that each said set of food slices is deposited to lay over a previously deposited set of food slices.

25. A mechanized system for the automated preparation of food set-ups, comprising:

a paper supply means for supplying a continuous sheet of paper;

a conveyor assembly for conveying said sheet of paper thereon, said conveyor assembly having a feed end and a discharge end thereon, said feed end including feeder means to feed said paper from said paper supply and onto said conveyor assembly;

first and second slicer means sequentially positioned along said conveyor assembly for sequentially providing food slices, said first slicer means configured to deposit a first layer of horizontally spaced food slices onto said sheet of paper substantially within a first horizontal plane, said second slicer means positioned downstream of said first slicer means and configured to deposit a second set of horizontally spaced food slices substantially within a second horizontal plane;

said first and second slicer means including a moveable canister mounted on a frame and positioned above said sheet of paper, said canister equipped to hold multiple food items therein, and a slicer blade positioned beneath said canister and extending across said paper perpendicular to the path of travel thereof, said blade being of sufficient length to simultaneously slice more than one food item within said canister;

drive means for supplying operating power to said conveyor assembly and said slicer means; and timing means for synchronizing said first and second slicer means so that said second set of food slices is deposited to lay over on said first set of food slices;

whereby said layers of food slices form a set-up including a plurality of stacked layers wherein each layer includes food slices arranged substantially within a single horizontal plane.

26. A mechanized system for the automated preparation of food set-ups, comprising:

a conveyor assembly having a feed end and a discharge end thereon;

first and second slicer means sequentially positioned along said conveyor assembly for sequentially providing food slices, said first slicer means capable of depositing a first layer of food slices onto said conveyor assembly substantially within a first horizontal plane, said second slicer means positioned along said conveyor assembly and downstream of said first slicer means, said second slicer means capable of providing a second set of food slices substantially within a second horizontal plane;

said first and said second slicer means include a moveable canister mounted on a frame and positioned above said conveyor assembly, said canister equipped to hold multiple food items therein; a slicer blade positioned beneath said canister and above said conveyor assembly, said slicer blade extending across said conveyor assembly perpendicular to the path of travel thereof, said blade being of sufficient length to simultaneously slice more than one food item within said canister;

drive means for driving said conveyor assembly and said slicer means; and timing means for synchronizing said first and said second slicer means and said conveyor assembly so that said second set of food slices is supplied by said second slicer means to lay over said first set of food slices;

whereby, said first and said second slicer means compile a food set-up having a plurality of stacked layers wherein each layer includes food slices arranged substantially within a single horizontal plane.

27. A mechanized system for the automated preparation of food set-ups, comprising:

a paper supply means for supplying a continuous web of paper;

a conveyor assembly including a continuous conveyor for conveying said web thereon, said conveyor having a feed end and a discharge end thereon, said feed end including feeder means to feed said web from said paper supply means and onto said conveyor;

a plurality of slicer means sequentially positioned along said conveyor for sequentially providing food slices, each of said slicer means capable of depositing a single layer of food slices onto said web of paper and substantially within a single horizontal plane;

each of said slicer means include a moveable canister mounted on a frame and positioned above said web of paper, said canister dimensioned to hold multiple food items therein and, a slicer blade positioned beneath said canister and extending across said web of paper perpendicular to the path of travel thereof, said blade being of sufficient length to simultaneously slice more than one food item within said canister;

cutting means disposed downstream of said slicer means and along said conveyor for cutting said web of paper to predetermined lengths, said cutting means including a knife positioned over said conveyor to slice said web to said predetermined lengths;

wrapper means associated with said cutting means to wrap each set-up.

28. A method for the automated preparation of food set-ups, comprising:

loading one or more food items into a first canister, said first canister positioned over a first slicer blade and moveable relative to said slicer blade;

positioning said food items within said first canister in a side-by-side arrangement to expose one end of each said food item for slicing thereof by said slicer blade;

slicing said one end of each said food item within said canister to provide a first layer of food slices;

depositing said first layer onto a conveyor and substantially within a first horizontal plane;

conveying said first layer to a second slicer station;

slicing a second set of food items at said second station to form a second layer of food slices;

stacking said second layer directly over said first layer and substantially within a second horizontal plane;

wrapping said first and second layers following said stacking thereof; and packaging said first and second layers following said wrapping thereof.

29. A method for the automated preparation of food set-ups, comprising:

slicing a first set of food items at a first slicer station to provide a first layer of food slices;

depositing said first layer onto a conveyor and substantially within a first horizontal plane;

conveying said first layer to a second slicer station;

loading one or more food items into a second moveable canister, said second canister positioned over a second slicer blade and moveable relative to said slicer blade;

positioning said food items within said second canister in a side-by-side arrangement to expose one end of each said food item for slicing thereof by said second slicer blade;

stacking said second layer directly over said first layer and substantially within a second horizontal plane;

wrapping said first and second layers following said stacking thereof; and packaging said first and second layers following said wrapping thereof.

* * * * *